US011056770B2

(12) United States Patent
Su et al.

(10) Patent No.: US 11,056,770 B2
(45) Date of Patent: Jul. 6, 2021

(54) MULTI-ANTENNA SYSTEM AND ELECTRONIC DEVICE THEREOF

(71) Applicant: ASUSTeK COMPUTER INC., Taipei (TW)

(72) Inventors: Saou-Wen Su, Taipei (TW); Wei-Hsuan Chang, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 49 days.

(21) Appl. No.: 16/708,593

(22) Filed: Dec. 10, 2019

(65) Prior Publication Data

US 2020/0203808 A1 Jun. 25, 2020

(30) Foreign Application Priority Data

Dec. 19, 2018 (TW) ..... 107146012

(51) Int. Cl.

| | |
|---|---|
| ***H01Q 1/38*** | (2006.01) |
| ***H01Q 1/24*** | (2006.01) |
| ***H01Q 9/04*** | (2006.01) |
| ***H01Q 9/42*** | (2006.01) |
| ***H01Q 5/378*** | (2015.01) |

(52) U.S. Cl.

CPC ..... *H01Q 1/243* (2013.01); *H01Q 1/38* (2013.01); *H01Q 5/378* (2015.01); *H01Q 9/0421* (2013.01); *H01Q 9/42* (2013.01)

(58) Field of Classification Search

CPC ..... H01G 1/243; H01G 5/378; H01G 1/38; H01G 9/0421; H01G 9/42

See application file for complete search history.

(56) References Cited

U.S. PATENT DOCUMENTS

| | | | |
|---|---|---|---|
| 2009/0046008 | A1 | 2/2009 | Murakami et al. |
| 2015/0020157 | A1 | 1/2015 | Kim et al. |
| 2018/0076505 | A1 | 3/2018 | Hu et al. |
| 2018/0159214 | A1 | 6/2018 | Zolomy et al. |

FOREIGN PATENT DOCUMENTS

| | | | |
|---|---|---|---|
| CN | 105932420 | A | 9/2016 |
| TW | 201807881 | A | 3/2018 |

*Primary Examiner* — Graham P Smith

(74) *Attorney, Agent, or Firm* — McClure, Qualey & Rodack, LLP

(57) ABSTRACT

A multi-antenna system includes a conductive plane with four adjacent sides, a main antenna unit disposed on any one of the four sides, a first secondary antenna unit disposed on any one of the four side, a second secondary antenna unit disposed on any one of the four sides of the conductive plane except the side on which the main antenna unit is disposed, a switching circuit disposed on the conductive plane and is selectively electrically connected to the first secondary antenna unit or the second secondary antenna unit and a wireless communications module disposed on the conductive plane and electrically connected to the switching circuit and the main antenna unit. The first secondary antenna unit is spaced apart from the main antenna unit by a spacing, where the spacing is greater than 0.5 times a wavelength distance of a low-frequency operating frequency of the multi-antenna system.

10 Claims, 6 Drawing Sheets

MULTI-ANTENNA SYSTEM AND ELECTRONIC DEVICE THEREOF

CROSS-REFERENCE TO RELATED APPLICATION

This application claims the priority benefit of Taiwan Application Serial No. 107146012, filed on Dec. 19, 2018. The entirety of the above-described patent application is hereby incorporated by reference herein and made a part of the specification.

BACKGROUND OF THE INVENTION

Field of the Invention

The disclosure relates to a multi-antenna system and an electronic device thereof.

Description of the Related Art

Antennas applied to mobile devices, such as notebook computers, tablet computers, and mobile phones are mostly built-in antennas, and particular antenna space needs to be reserved in the internal space of these devices. To make mobile devices lightweight, thin and easy to carry and to achieve aesthetics and tactile impression of the industrial designs of the products, metals or other conductive materials are commonly used in the appearance design of the products. However, insufficient space or clearance area degrades the radiation characteristics of the antennas and sufficient clearance area can increase the thickness of the device. Accordingly, the antenna design faces a great challenge in meeting the above requirements.

BRIEF SUMMARY OF THE INVENTION

According to the first aspect of the disclosure, a multi-antenna system is provided. The multi-antenna system includes a conductive plane, a main antenna unit, a first secondary antenna unit, a second secondary antenna unit, a switching circuit and a wireless communications module. The conductive plane includes four adjacent sides. The main antenna unit is disposed on one of the four sides. The first secondary antenna unit is disposed on one of the four sides and apart from the main antenna unit by a spacing, where the spacing is greater than 0.5 times a wavelength of a low-frequency operating frequency. The second secondary antenna unit is disposed on one of the four sides of the conductive plane except the side on which the main antenna unit is disposed. The switching circuit is disposed on the conductive plane and is selectively electrically connected to the first secondary antenna unit or the second secondary antenna unit. The wireless communications module is disposed on the conductive plane and is electrically connected to the switching circuit and the main antenna unit. When the switching circuit is electrically connected to the first secondary antenna unit, the main antenna unit and the first secondary antenna unit constitute a first antenna combination; when the switching circuit is electrically connected to the second secondary antenna unit, the main antenna unit and the second secondary antenna unit constitute a second antenna combination; when a radio frequency signal is fed to the second antenna combination, a polarization direction of a radiation pattern generated by the second secondary antenna unit is orthogonal to a polarization direction of a radiation pattern generated by the main antenna unit.

According to the second aspect of the disclosure, an electronic device is provided. The electronic device includes a main body, a conductive plane, a main antenna unit, a first secondary antenna unit, a second secondary antenna unit, a switching circuit and a wireless communications module. The conductive plane is disposed in the main body and comprising four adjacent sides. The main antenna unit is disposed on any one of the four sides. The first secondary antenna unit is disposed on any one of the four sides and spaced apart from the main antenna unit by a spacing, where the spacing is greater than 0.5 times a wavelength of a low-frequency operating frequency. The second secondary antenna unit is disposed on any one of the four sides of the conductive plane except the side on which the main antenna unit is disposed. The switching circuit is disposed on the conductive plane and is selectively electrically connected to the first secondary antenna unit or the second secondary antenna unit. The wireless communications module is disposed on the conductive plane and is electrically connected to the switching circuit and the main antenna unit. When the switching circuit is electrically connected to the first secondary antenna unit, the main antenna unit and the first secondary antenna unit constitute a first antenna combination; when the switching circuit is electrically connected to the second secondary antenna unit, the main antenna unit and the second secondary antenna unit constitute a second antenna combination; when a radio frequency signal is fed to the second antenna combination, a polarization direction of a radiation pattern generated by the second secondary antenna unit is orthogonal to a polarization direction of a radiation pattern generated by the main antenna unit.

The detailed descriptions of other effects and embodiments of the disclosure are provided below with reference to the accompanying drawings.

BRIEF DESCRIPTION OF THE DRAWINGS

To more clearly describe the technical solutions in the embodiments of the disclosure or in the prior art, the following will briefly introduce the drawings required for describing the embodiments or the prior art. It is apparent that the drawings in the following description are only some embodiments described in the disclosure, and a person of ordinary skill in the art may obtain other drawings on the basis of these drawings without any creative effort.

DETAILED DESCRIPTION OF THE EMBODIMENTS

To make the objectives, features, and effects of the disclosure more comprehensible, embodiments and figures for describing in detail the disclosure are provided below.

It should be understood that although terms such as "first", "second", and "third" in this specification may be used for describing various elements, components, areas, layers, and/or parts, the elements, components, areas, layers, and/or parts are not limited by such terms. The terms are only used to distinguish one element, component, area, layer, or part from another element, component, area, layer, or part. Therefore, the "first element", "component, "area", "layer", or "part" described below may also be referred to as a second element, component, area, layer, or part without departing from the teachings of the disclosure.

In addition, spatially relative terms such as "below", "bottom", "on" or "top" are used in this specification to describe a relationship between one element and another element, as shown in the figures. It should be understood that such spatially relative terms are intended to encompass different orientations of the device in addition to the orientation depicted in the figures. When a device in a figure is turned over, an element described as being on the "lower" side of another element will then be on the "upper" side of the other element. Therefore, the exemplary term "lower" encompasses both "lower" and "upper" orientations depending on the orientation of the figure. When a device in a figure is turned over, an element described as being "below" relative to another element will then be "above" relative to the other element. Therefore, the term "below" encompasses both the above and below orientations.

Figure 1:
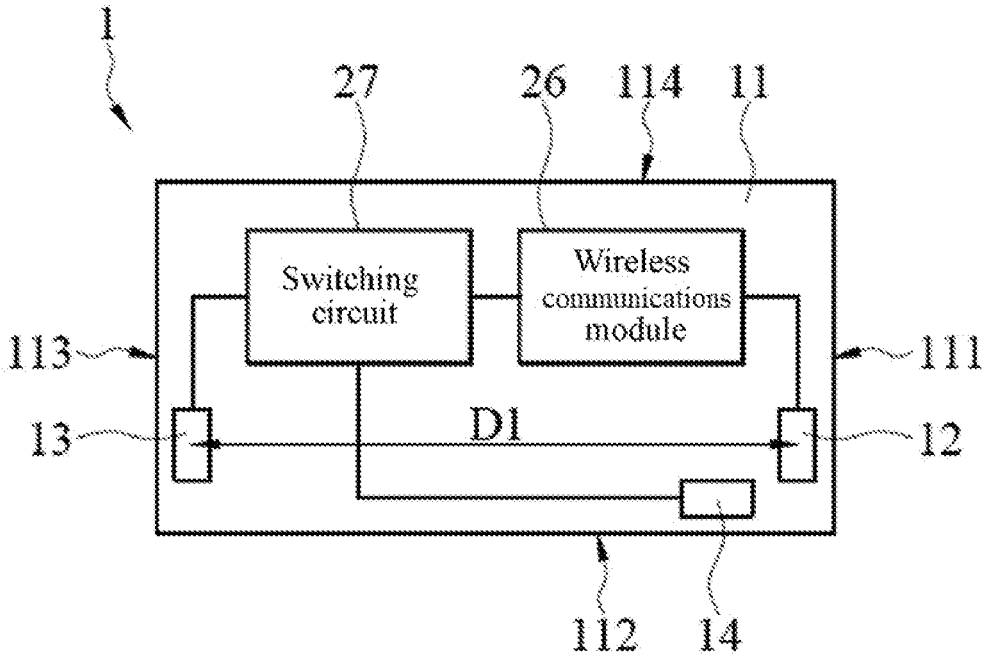
FIG. 1 is a schematic top view of an embodiment of a multi-antenna system according to the disclosure.
Figure 2:
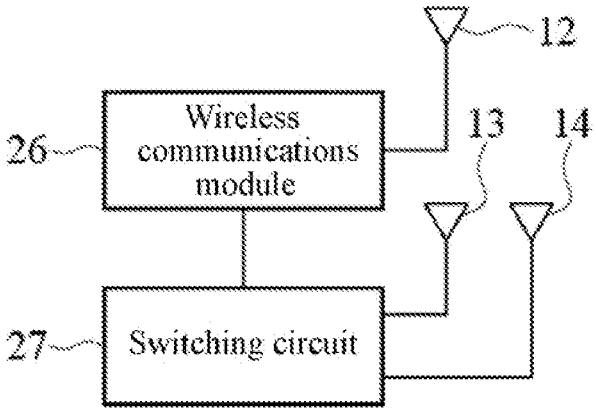
FIG. 2 is a schematic functional diagram of an implementation of the multi-antenna system in FIG. 1.

FIG. 1 discloses a multi-antenna system 1 including a high-frequency operating frequency and a low-frequency operating frequency. The multi-antenna system 1 includes a conductive plane 11, and a main antenna unit 12, a first secondary antenna unit 13, a second secondary antenna unit 14, a switching circuit 27 and a wireless communications module 26 that are disposed on the conductive plane 11. The main antenna unit 12 is connected to the wireless communications module 26, the wireless communications module 26 is connected to the switching circuit 27, and the switching circuit 27 is connected to the first secondary antenna unit 13 and the second secondary antenna unit 14. The switching circuit 27 is selectively electrically connected to the first secondary antenna unit 13 or the second secondary antenna unit 14. When the switching circuit 27 is electrically connected to the first secondary antenna unit 13, the main antenna unit 12 and the first secondary antenna unit 13 constitute a first antenna combination through the electrical connection between the switching circuit 27 and the wireless communications module 26. When the switching circuit 27 is electrically connected to the second secondary antenna unit 14, the main antenna unit 12 and the second secondary antenna unit 14 constitute a second antenna combination through the electrical connection between the switching circuit 27 and the wireless communications module 26. FIG. 2 is a schematic functional diagram of an implementation of the multi-antenna system 1 in FIG. 1 (FIG. 2 is only for illustration, the conductive plane 11 is not drawn). As described above, the wireless communications module 26 is electrically connected to the main antenna unit 12 and the switching circuit 27. Therefore, when the switching circuit 27 is electrically connected to the first secondary antenna unit 13, the multi-antenna system 1 transmits and receives radio signals through the first antenna combination formed by the main antenna unit 12 and the first secondary antenna unit 13. When the switching circuit 27 is electrically connected to the second secondary antenna unit 14, the multi-antenna system 1 transmits and receives radio signals through the second antenna combination formed by the main antenna unit 12 and the second secondary antenna unit 14.

In an embodiment, the conductive plane 11 is a grounding part of a metal housing of the electronic device or a sputtered metal part inside a plastic housing of the electronic device.

Figure 3:
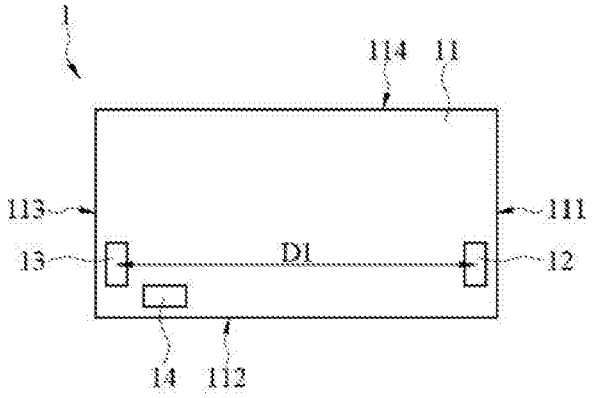
FIG. 3 is a schematic top view of an embodiment of a multi-antenna system according to the disclosure.
Figure 4:
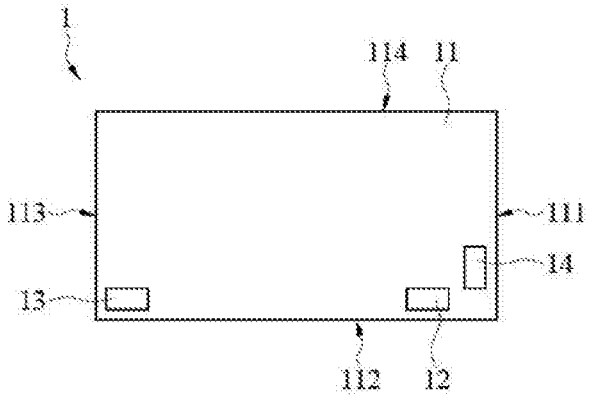
FIG. 4 is a schematic top view of an embodiment of a multi-antenna system according to the disclosure.
Figure 5:
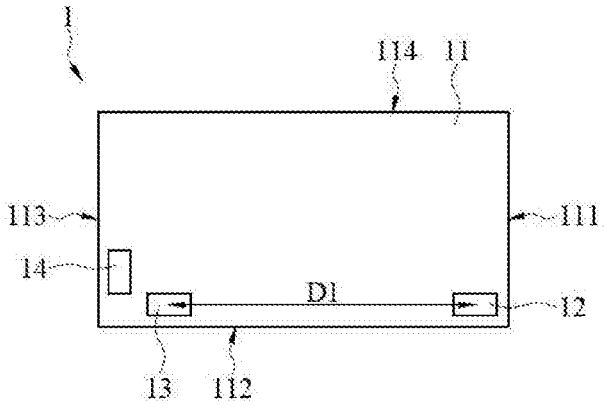
FIG. 5 is a schematic top view of an embodiment of a multi-antenna system according to the disclosure.

Refer to FIG. 1 and FIG. 3 to FIG. 9. FIG. 3 to FIG. 9 are only used to illustrate the placement of the main antenna unit 12, the first secondary antenna unit 13 and the second secondary antenna unit 14 on the conductive plane 11, with the wireless communications module 26 and the switching circuit 27 on the conductive plane 11 being omitted. As shown in FIG. 1 and FIG. 3 to FIG. 9, the conductive plane 11 includes four adjacent sides (for convenience of description, the four adjacent sides are respectively referred to as a first side 111, a second side 112, a third side 113 and a fourth side 114 below). The main antenna unit 12 is disposed on any one of the four sides 111, 112, 113 and 114. In an embodiment, as shown in FIG. 1, FIG. 3, FIG. 6, FIG. 7, FIG. 8 and FIG. 9, the main antenna unit 12 extends along the first side 111 and is disposed on the first side 111; or as shown in FIG. 4 and FIG. 5, the main antenna unit 12 extends along the second side 112 and is disposed on the second side 112. In other embodiments, the main antenna unit 12 extends along the third side 113 or the fourth side 114 and is disposed on the third side 113 or the fourth side 114. The disclosure is not limited to the examples in FIG. 1 and FIG. 3 to FIG. 9.

Figure 6:
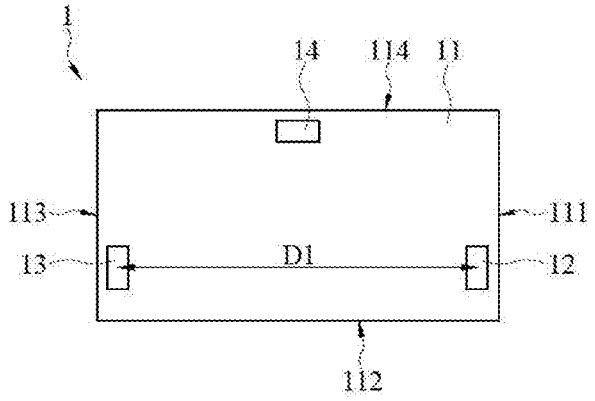
FIG. 6 is a schematic top view of an embodiment of a multi-antenna system according to the disclosure.
Figure 7:
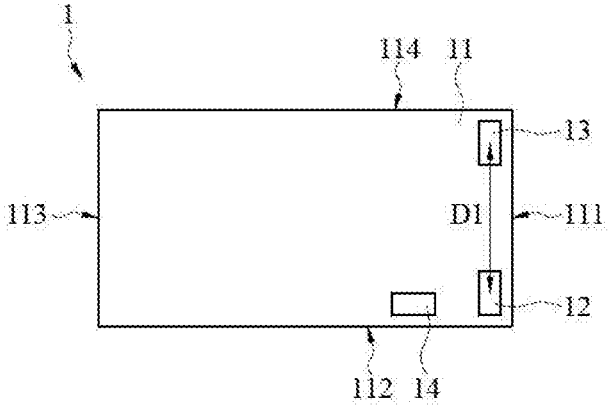
FIG. 7 is a schematic top view of an embodiment of a multi-antenna system according to the disclosure.
Figure 8:
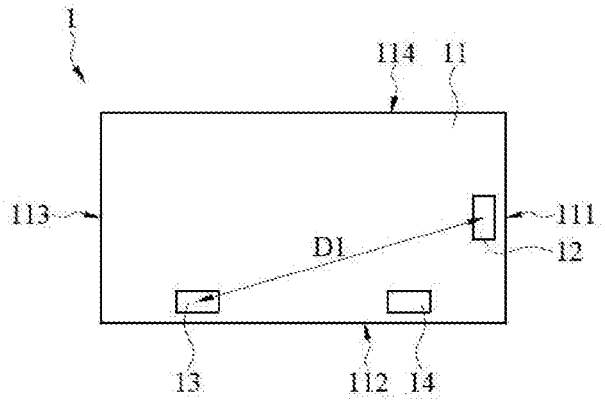
FIG. 8 is a schematic top view of an embodiment of a multi-antenna system according to the disclosure.

The first secondary antenna unit 13 is also disposed on any one of the four sides 111, 112, 113 and 114. In an embodiment, as shown in FIG. 7, the first secondary antenna unit 13 extends along the first side 111 and is disposed on the first side 111; as shown in FIG. 4, FIG. 5 and FIG. 8, the first secondary antenna unit 13 extends along the second side 112 and is disposed on the second side 112; or as shown in FIG. 1, FIG. 3, FIG. 6 and FIG. 9, the first secondary antenna unit 13 extends along the third side 113 and is disposed on the third side 113. In other embodiments, the first secondary antenna unit 13 extends along the fourth side 114 and is disposed on the fourth side 114. Further, the first secondary antenna unit 13 is spaced apart from the main antenna unit 12 by a spacing D1. To provide the multi-antenna system 1 with a spatial diversity feature, the spacing D1 is at least greater than 0.5 times a wavelength of the low-frequency operating frequency. In an embodiment, the spacing D1 is measured from a structural center of the main antenna unit 12 to a structural center of the first secondary antenna unit 13 in the structure.

Figure 9:
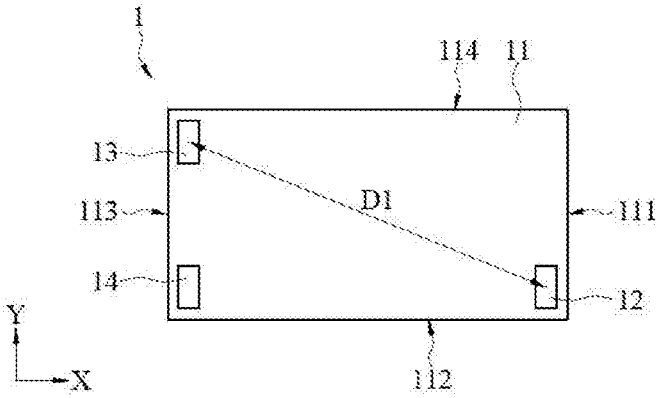
FIG. 9 is a schematic top view of an embodiment of a multi-antenna system according to the disclosure.

The second secondary antenna unit 14 is disposed on any one of the four sides 111, 112, 113 and 114 except the side on which the main antenna unit 12 is disposed. In some embodiments, when the main antenna unit 12 is disposed on the first side 111, the second secondary antenna unit 14 is disposed on the second side 112, the third side 113 or the fourth side 114; when the main antenna unit 12 is disposed on the second side 112, the second secondary antenna unit 14 is disposed on the first side 111, the third side 113 or the fourth side 114; when the main antenna unit 12 is disposed on the third side 113, the second secondary antenna unit 14 is disposed on the first side 111, the second side 112 or the fourth side 114; and when the main antenna unit 12 is disposed on the fourth side 114, the second secondary antenna unit 14 is disposed on the first side 111, the second side 112 or the third side 113. As shown in FIG. 1, FIG. 3, FIG. 7 and FIG. 8, the second secondary antenna unit 14 extends along the second side 112 on which the main antenna unit 12 is not disposed and is disposed on the second side 112. As shown in FIG. 4, the second secondary antenna unit 14 extends along the first side 111 on which the main antenna unit 12 is not disposed and is disposed on the first side 111. As shown in FIG. 5 and FIG. 9, the second secondary antenna unit 14 extends along the third side 113 on which the main antenna unit 12 is not disposed and is disposed on the third side 113. As shown in FIG. 6, the second secondary antenna unit 14 extends along the fourth side 114 on which the main antenna unit 12 is not disposed and is disposed on the fourth side 114. To provide the multi-antenna system 1 with a polarization diversity fature, when a radio frequency signal is fed to the second antenna combination, a polarization direction of a radiation pattern generated by the second secondary antenna unit 14 needs to be orthogonal to a polarization direction of a radiation pattern generated by the main antenna unit 12.

Based on this, the switching circuit 27 chooses to connect to the first secondary antenna unit 13 or the second secondary antenna unit 14. A processor included in an electronic device to which the multi-antenna system 1 is applied determines in real time a throughput of received data by using a software algorithm and controls the switching circuit 27 to choose the first secondary antenna unit 13 or the second secondary antenna unit 14 to combine with the main antenna unit 12, to enable the wireless communications module 26 to transmit and receive radio signals through the main antenna unit 12 and the first secondary antenna unit 13 or through the main antenna unit 12 and the second secondary antenna unit 14, thereby obtaining optimal communications coverage. The multi-antenna system 1 operates in a dual-frequency mode for both the first antenna combination and the second antenna combination. Therefore, the multi-antenna system 1 includes fewer antenna units (only three antenna units) which occupy a small space, thus meeting the requirements of notebook computers for a lightweight, thin and narrow-bezel structure and improving the transmission and reception efficiency of radio signals.

In an embodiment, the main antenna unit 12, the first secondary antenna unit 13 and the second secondary antenna unit 14 are respectively a dipole antenna, a slot antenna, a loop antenna or a planar inverted-F antenna (PIFA). Further, the main antenna unit 12, the first secondary antenna unit 13 and the second secondary antenna unit 14 are manufactured by using a printed circuit board (PCB) process, a flexible printed circuit board (FPCB) process or a laser direct structuring (LDS) process. Further, the low-frequency operating frequency and the high-frequency operating frequency respectively cover an operating band for 2.4 GHz operation and an operating band for 5 GHz operation.

Figure 11:
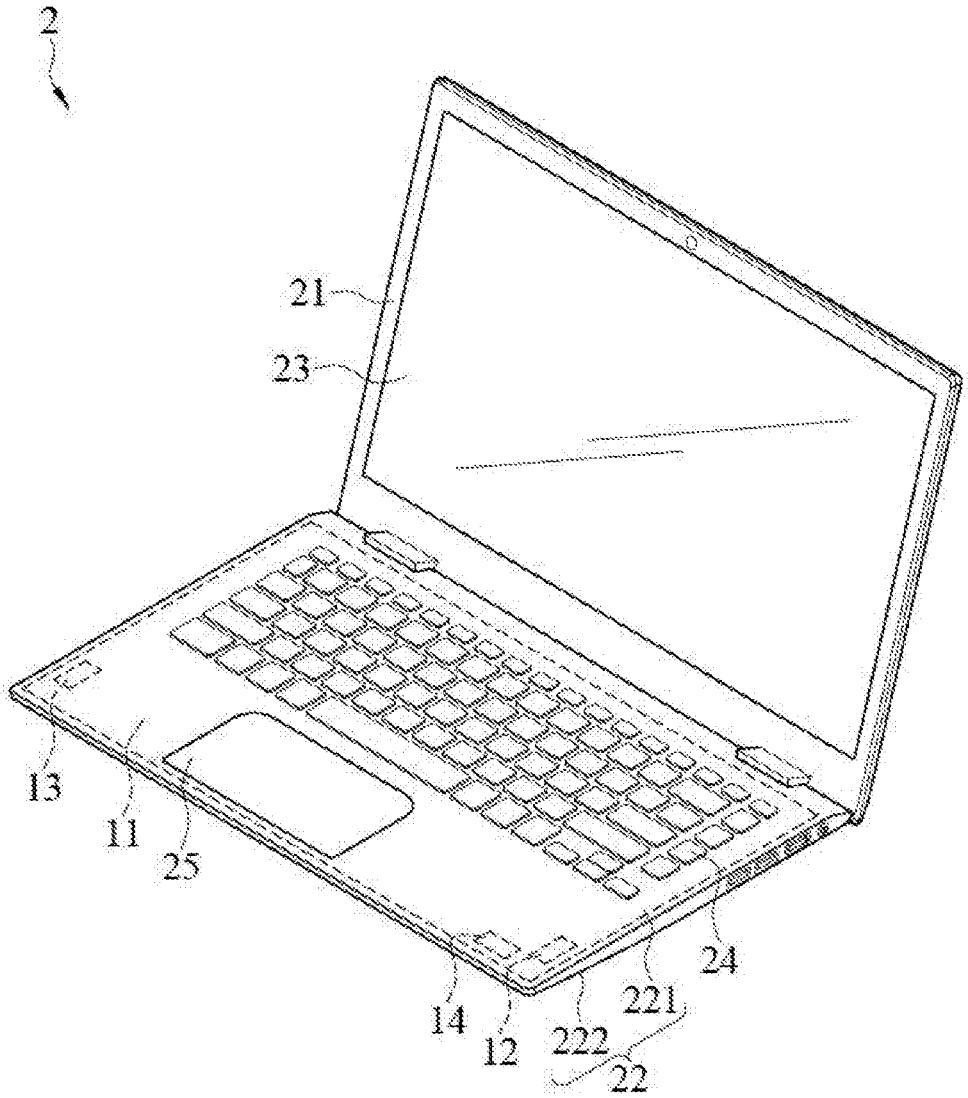
FIG. 11 is a schematic diagram of an embodiment of an electronic device to which the multi-antenna system of the disclosure is applied.
Figure 12:
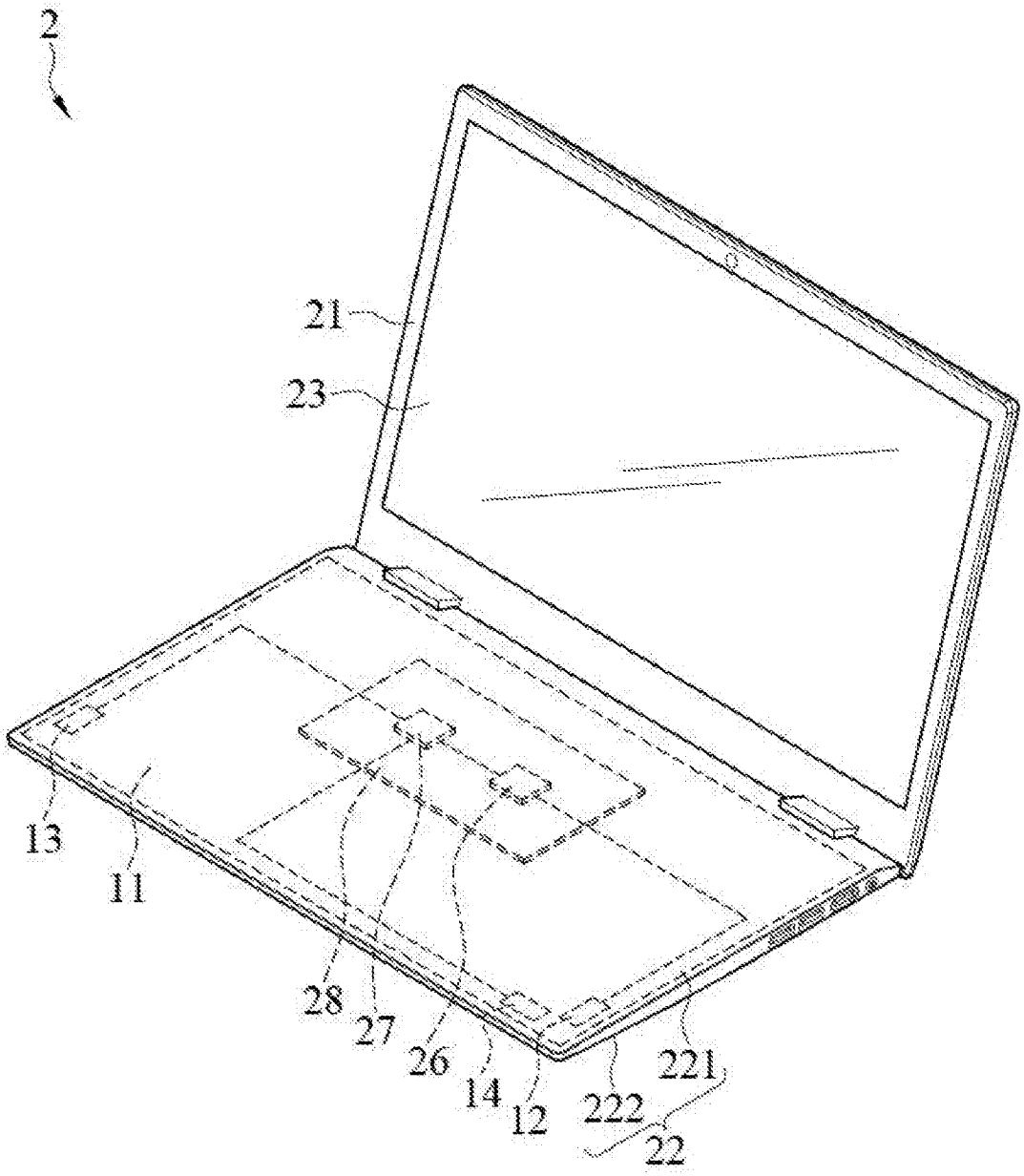
FIG. 12 is a schematic diagram of an implementation of the electronic device in FIG. 11.

In an embodiment, referring to FIG. 11 and FIG. 12, FIG. 11 shows an electronic device 2 to which the multi-antenna system 1 is applied, and the electronic device 2 is a notebook computer. The electronic device 2 includes a screen body 21 and a main body 22. In an embodiment, the screen body 21 includes a screen 23, and the main body 22 includes input devices such as a keyboard 24 and a touchpad 25, and a motherboard 28. The antenna system 1 is located in the main body 22. Based on this, the antenna system 1 disposed in the main body 22 is not restricted by the electronic device 2 with a lightweight, thin and narrow-bezel structure, and is well applied to such existing electronic devices 2.

In an embodiment, materials of the screen body 21 and the main body 22 of the electronic device 2 are metal. In this case, any one of an upper system housing 221 or a lower system housing 222 of the main body 22 is used as the conductive plane 11. In some other embodiments, the materials of the screen body 21 and the main body 22 are plastic. In this case, the conductive plane 11 is a sputtered metal part of the upper system housing 221 or the lower system housing 222 of the plastic main body 22. In this embodiment, the conductive plane 11 is in the shape of a rectangle, to be specific, the first side 111 of the conductive plane 11 is parallel to the third side 113, the first side 111 is perpendicular to the second side 112 and the fourth side 114, and the second side 112 is parallel to the fourth side 114.

The placement of the antenna units 12, 13, 14 on the conductive plane 11 is described in further detail below according to the rectangular conductive plane 11.

As shown in FIG. 1 and FIG. 3, a length direction of the main antenna unit 12 is parallel to the first side 111, a length direction of the first secondary antenna unit 13 is parallel to the third side 113, and a length direction of the second secondary antenna unit 14 is parallel to the second side 112. Based on this, according to the rectangular conductive plane 11, the length direction of the first secondary antenna unit 13 is parallel to that of the main antenna unit 12, and the length direction of the second secondary antenna unit 14 is perpendicular to that of the main antenna unit 12 and that of the first secondary antenna unit 13.

As shown in FIG. 4, the length directions of the main antenna unit 12 and the first secondary antenna unit 13 are parallel to the second side 112, and the length direction of the second secondary antenna unit 14 is parallel to the first side 111. Based on this, according to the rectangular conductive plane 11, the length direction of the first secondary antenna unit 13 is parallel to that of the main antenna unit 12, and the length direction of the second secondary antenna unit 14 is perpendicular to that of the main antenna unit 12 and that of the first secondary antenna unit 13.

As shown in FIG. 5, the length directions of the main antenna unit 12 and the first secondary antenna unit 13 are parallel to the second side 112, and the length direction of the second secondary antenna unit 14 is parallel to the third side 113. According to the rectangular conductive plane 11, the length direction of the first secondary antenna unit 13 is parallel to that of the main antenna unit 12, the length direction of the second secondary antenna unit 14 is perpendicular to that of the main antenna unit 12 and that of the first secondary antenna unit 13.

As shown in FIG. 6, the length direction of the main antenna unit 12 is parallel to the first side 111, the length direction of the first secondary antenna unit 13 is parallel to the third side 113, and the length direction of the second secondary antenna unit 14 is parallel to the fourth side 114. Based on this, according to the rectangular conductive plane 11, the length direction of the first secondary antenna unit 13 is parallel to that of the main antenna unit 12, and the length direction of the second secondary antenna unit 14 is perpendicular to that of the main antenna unit 12 and that of the first secondary antenna unit 13.

As shown in FIG. 7, the length directions of the main antenna unit 12 and the first secondary antenna unit 13 are parallel to the first side 111, and the length direction of the second secondary antenna unit 14 is parallel to the second side 112. Based on this, according to the rectangular conductive plane 11, the length direction of the first secondary antenna unit 13 is parallel to that of the main antenna unit 12, and the length direction of the second secondary antenna unit 14 is perpendicular to that of the main antenna unit 12 and that of the first secondary antenna unit 13.

As shown in FIG. 8, the length direction of the main antenna unit 12 is parallel to the first side 111, and the length directions of the first secondary antenna unit 13 and the second secondary antenna unit 14 are parallel to the second side 112. Based on this, according to the rectangular conductive plane 11, the length directions of the first secondary antenna unit 13 and the second secondary antenna unit 14 are perpendicular to that of the main antenna unit 12.

In the second secondary antenna unit 14 and the main antenna unit 12 shown in FIG. 1 and FIG. 3 to FIG. 8, the length direction of the second secondary antenna unit 14 is perpendicular to that of the main antenna unit 12. In other embodiments, the length direction of the second secondary antenna unit 14 is parallel to that of the main antenna unit 12. As shown in FIG. 9, the length direction of the main antenna unit 12 is parallel to the first side 111, the length directions of the second secondary antenna unit 14 and the first secondary antenna unit 13 are parallel to the third side 113, and according to the rectangular conductive plane 11, the length directions of the second secondary antenna unit and the first secondary antenna unit 13 are parallel to that of the main antenna unit 12. In an embodiment in FIG. 9, the main antenna unit 12 and the second secondary antenna unit 14 are respectively a dipole antenna and a slot antenna. It should be noted that, although the length direction of the second secondary antenna unit 14 is parallel to that of the main antenna unit 12, the main antenna unit 12 produces a polarization direction in a Y-axis direction and the second secondary antenna unit 14 produces a polarization direction in an X-axis direction when the main antenna unit 12 is combined with the second secondary antenna unit 14 and a radio frequency signal is fed to the main antenna unit 12 and the second secondary antenna unit 14, i.e., a polarization direction of a radiation pattern generated by the main antenna unit 12 is orthogonal to a polarization direction of a radiation pattern generated by the second secondary antenna unit 14. The main antenna unit 12 is combined with the second secondary antenna unit 14 to form antenna radiation patterns with polarization diversity.

Figure 10:
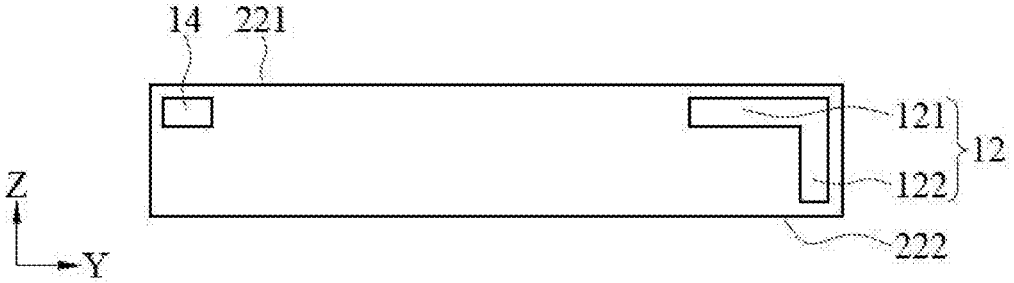
FIG. 10 is a side view of an implementation of the multi-antenna system in FIG. 9.

In an embodiment, FIG. 10 is a side view of an implementation of the multi-antenna system 1 in FIG. 9. As shown in FIG. 10, the main body 22 includes an upper system housing 221 and a lower system housing 222, and the main antenna unit 12 includes a signal feed-in part 121 and an antenna ground part 122. The signal feed-in part 121 extends along a surface of the upper system housing 221, the antenna ground part 122 extends from the upper system housing 221 toward the lower system housing 222, and the second secondary antenna unit 14 extends along the surface of the upper system housing 221. To be specific, along a Z-axis direction, the second secondary antenna unit 14 is perpendicular to the main antenna unit 12. Further, in the example in FIG. 10, both the main antenna unit 12 and the second secondary antenna unit 14 are planar inverted-F antennas. When the second secondary antenna unit 14 is combined with the main antenna unit 12 and a radio frequency signal is fed to the second secondary antenna unit 14 and the main antenna unit 12, the main antenna unit 12 produces a polarization direction in the Z-axis direction, the second secondary antenna unit 14 produces a polarization direction parallel to an X-axis/Y-axis plane, and a polarization direction of a radiation pattern generated by the main antenna unit 12 is also orthogonal to a polarization direction of a radiation pattern generated by the second secondary antenna unit 14. Therefore, the main antenna unit 12 is combined with the second secondary antenna unit 14 to form antenna radiation patterns with polarization diversity.

In an embodiment, the multi-antenna system 1 is located in the main body 22. Referring to FIG. 12, the electronic device 2 further includes a motherboard 28 inside the main body 22, and the motherboard 28 is disposed on the conductive plane 11. The motherboard 28 is configured for the arrangement of the wireless communications module 26 and the switching circuit 27. Based on this, the multi-antenna system 1 located in the main body of the electronic device 2 is not restricted by the electronic device 2 with a lightweight, thin and narrow-bezel structure.

The above-described embodiments and/or implementations are merely illustrative of preferred embodiments and/or implementations for practicing the techniques of the disclosure, and are not intended to limit the embodiments of the techniques of the disclosure in any manner, and any person skilled in the art may make various variations or modifications to obtain other equivalent embodiments without departing from the scope of the technical means disclosed herein, and all such embodiments should still be considered to be substantially the same techniques or embodiments as the disclosure.

What is claimed is:

1. A multi-antenna system, comprising a high-frequency operating frequency and a low-frequency operating frequency, wherein the multi-antenna system comprises:

a conductive plane, comprising four adjacent sides;

a main antenna unit, disposed on one of the four sides;

a first secondary antenna unit, disposed on one of the four sides and apart from the main antenna unit by a spacing, wherein the spacing is greater than 0.5 times a wavelength of the low-frequency operating frequency;

a second secondary antenna unit, disposed on one of the four sides except the side on which the main antenna unit is disposed;

a switching circuit, disposed on the conductive plane and selectively electrically connected to the first secondary antenna unit or the second secondary antenna unit; and a wireless communications module, disposed on the conductive plane and electrically connected to the switching circuit and the main antenna unit, wherein when the switching circuit is electrically connected to the first secondary antenna unit, the main antenna unit and the first secondary antenna unit constitute a first antenna combination; when the switching circuit is electrically connected to the second secondary antenna unit, the main antenna unit and the second secondary antenna unit constitute a second antenna combination; and when a radio frequency signal is fed to the second antenna combination, a polarization direction of a radiation pattern generated by the second secondary antenna unit is orthogonal to a polarization direction of a radiation pattern generated by the main antenna unit.

2. The multi-antenna system according to claim 1, wherein the four sides are respectively a first side, a second side, a third side and a fourth side, the main antenna unit is disposed on the first side, the second secondary antenna unit is disposed on the second side, the third side or the fourth side, and a length direction of the main antenna unit is parallel to the first side, wherein a length direction of the second secondary antenna unit is parallel to the second side when the second secondary antenna unit is disposed on the second side, is parallel to the third side when the second secondary antenna unit is disposed on the third side, and is parallel to the fourth side when the second secondary antenna unit is disposed on the fourth side.

3. The multi-antenna system according to claim 2, wherein a length direction of the first secondary antenna unit is parallel to the first side when the first secondary antenna unit is disposed on the first side, is parallel to the second side when the first secondary antenna unit is disposed on the second side, is parallel to the third side when the first secondary antenna unit is disposed on the third side, and is parallel to the fourth side when the first secondary antenna unit is disposed on the fourth side.

4. The multi-antenna system according to claim 3, wherein the first side is parallel to the third side, the first side is perpendicular to the second side and the fourth side, and the second side is parallel to the fourth side.

5. The multi-antenna system according to claim 1, wherein the length direction of the second secondary antenna unit is perpendicular to that of the main antenna unit.

6. The multi-antenna system according to claim 1, wherein the length direction of the second secondary antenna unit is parallel to that of the main antenna unit.

7. The multi-antenna system according to claim 6, wherein the main antenna unit and the second secondary antenna unit are respectively a dipole antenna and a slot antenna.

8. An electronic device, comprising:

a main body;

a conductive plane, located in the main body and comprising four adjacent sides;

a main antenna unit, disposed on any one of the four sides;

a first secondary antenna unit, disposed on one of the four sides and apart from the main antenna unit by a spacing, wherein the spacing is greater than 0.5 times a wavelength of a low-frequency operating frequency;

a second secondary antenna unit, disposed on one of the four sides except the side on which the main antenna unit is disposed;

a switching circuit, disposed on the conductive plane and selectively electrically connected to the first secondary antenna unit or the second secondary antenna unit; and a wireless communications module, disposed on the conductive plane and electrically connected to the switching circuit and the main antenna unit, wherein when the switching circuit is electrically connected to the first secondary antenna unit, the main antenna unit and the first secondary antenna unit constitute a first antenna combination; when the switching circuit is electrically connected to the second secondary antenna unit, the main antenna unit and the second secondary antenna unit constitute a second antenna combination; and when a radio frequency signal is fed to the second antenna combination, a polarization direction of a radiation pattern generated by the second secondary antenna unit is orthogonal to a polarization direction of a radiation pattern generated by the main antenna unit.

9. The electronic device according to claim 8, wherein a length direction of the second secondary antenna unit is perpendicular to that of the main antenna unit.

10. The electronic device according to claim 8, wherein a length direction of the second secondary antenna unit is parallel to that of the main antenna unit.

* * * * *